United States Patent [19]

Karl et al.

[11] 4,356,692

[45] Nov. 2, 1982

[54] METHOD AND APPARATUS FOR REMOVING AN IRREGULARITY IN A THREAD

[75] Inventors: Rupert Karl; Walter Mayer; Edmund Schuller; Erwin Braun, all of Ingolstadt, Fed. Rep. of Germany

[73] Assignee: Schubert & Salzer, Ingolstadt, Fed. Rep. of Germany

[21] Appl. No.: 191,343

[22] Filed: Sep. 26, 1980

[30] Foreign Application Priority Data

Sep. 29, 1979 [DE] Fed. Rep. of Germany ..... 2939644

[51] Int. Cl.[3] ..... D01H 15/02

[52] U.S. Cl. ..... 57/263

[58] Field of Search ..... 57/261, 263, 22; 242/35.5, 35.6

[56] References Cited

U.S. PATENT DOCUMENTS 4,083,171 4/1978 Konig et al. ..... 57/263

4,223,517 9/1980 Husges et al. ..... 57/263 X 4,232,508 11/1980 Husges et al. ..... 57/22

*Primary Examiner*—John Petrakes

[57] ABSTRACT

The method and apparatus for removing irregularities in a thread being produced on a machine as the thread is traveling to a takeup device. A thread reserve having a suction applied thereto causing a loop to be formed therein which contains said irregularity. An additional pair of loops are formed in said thread, one above and one below the thread reserve. The loop formed in the end of the thread reserve is severed from the thread and the two remaining loops are inserted into a thread joining device. A thread suction extractor associated with the thread joining device pulls the end portions of the pair of loops taut permitting the joining operation to take place and, after joining of the thread, removing the separated ends.

The thread reserve is provided with mechanism for maintaining the loop of thread extending therein separated and for severing and removing the portion of the loop containing the irregularity from the thread.

24 Claims, 12 Drawing Figures

METHOD AND APPARATUS FOR REMOVING AN IRREGULARITY IN A THREAD

BACKGROUND OF THE INVENTION

The present invention concerns a method for eliminating an irregularity in a thread by means of a thread joining device, and an apparatus for carrying out this method.

According to a known method (U.S. Pat. No. 4,223,517), a thread extending from take-off rollers to a spool is moved into an N shape whereupon, while simultaneously holding out the connecting section located between the two parallel thread sections, a tying device is then pivoted towards the thread and the parallel thread sections are joined to each other. To remove the excess connecting section separated during tying, there is provided a first thread suction extractor which simultaneously serves to receive the thread drawn off from a delivery point before tying and before the beginning of winding up by the take-off rollers. A second thread suction extractor which is disposed in the thread path between the take-off rollers and the tying device located in the working position, serves for temporary storage of the thread delivered subsequently during tying. Consequently, to carry out this method by means of the known apparatus, two stationary suction extractors with the associated valves and control devices are required per spinning station.

SUMMARY OF THE INVENTION

It is, therefore, the object of the present invention to provide a method and an apparatus which renders possible in an essentially more economical manner the elimination of an irregularity in a thread.

This object is achieved, according to the invention, by the fact that the thread above and below the extracted loop is inserted in the form of two loops in the thread joining device. The loop located between the two loops is separated and removed, and the thread delivered subsequently is moved into the region of the pneumatically removed loop and there stored temporarily while the thread pieces which have arisen are joined together and the excess ends are separated and removed. The continuously extracted loop arises after joining the thread in thread breakage elimination or mass joining after stopping of a machine. Due to the thread above and below this loop being inserted in the thread joining device, the irregularity in the thread which has arisen due to joining of the thread can be eliminated easily. Since, after insertion of the thread in the thread joining device the large loop is no longer required, it can be separated and removed. But this method also entails the supposition that the thread lengths for the two loops arising herein can be derived from the previously formed loop in the event that this should be desired. Re-delivery of thread through the spool or adaptation of the loop formation speed to the delivery speed of the thread is then not necessary. The subsequently delivered thread is now moved into the region of the pneumatically removed loop and there stored temporarily. Hence, the thread is extracted twice at one and the same point and hence with one and the same device, once to remove the irregularity and to make available a reserve for insertion of the thread in the thread joining device, and the other time for temporary storage during joining of the thread pieces which have arisen due to separation of the large loop. The excess ends are severed and removed on joining of the thread pieces. Basically, one thread joining device of this kind with this extractor can, of course, be provided per spinning station, but the actual advantage arises only if the thread joining device is movable along a plurality of spinning stations so that the extractor also is provided only once for this group of spinning stations.

Advantageously, the thread extracted in the form of a loop after joining is severed after reaching a fixed minimum loop size, the subsequently delivered thread is extracted further and the stopped thread section is kept separate from the subsequently delivered thread section and protected against untwisting until the two loops are inserted in the thread joining device. Due to the two loop sections being kept separate, withdrawal of the thread to form the two loops is rendered possible.

The practice of temporarily storing the thread pneumatically in a suction air pipe of flat cross-section and therein keeping the two thread sections of the loop separate from each other is known (German Offenlegungsschriften 1,785,321 and 2,234,610). Although twisting of the thread is made difficult by the fact that the suction air pipe exhibits an elongate cross-section, if nevertheless happens that the thread is twisted and forms knots which must then be removed from the thread in a separate re-winding process. As a remedy, there is already known the practice of constructing the suction air pipe so that it exhibits over the total length of the loop length to be expected a constriction by which the cross-sectional area of the suction air pipe, viewed in the direction of thread travel, is divided into two partial areas (German Auslegeschrift No. 2,802,913). By this means, the stationary and subsequently delivered thread sections are kept separate from each other over the whole length of the suction air pipe and thus formation of knots is prevented. For reasons of space, however, in practice, it is not always possible to provide sufficiently long suction air pipes; rather, the suction air pipes of several adjacent work stations already lead so early into a common extraction pipe that there is the risk of the loops of the individual work stations becoming entangled independently or with each other and therein breaking in an uncontrolled manner. Due to this, there is also the risk of only unusable, knotted thread lengths being available or these even being too short for the two loops so that satisfactory thread joining is not possible.

According to the invention, therefore, the thread is severed after reaching a fixed minimum loop size at which the risk of twisting does not yet exist. The thread section delivered subsequently from the delivery point is continuously extracted and thus kept under tension. Due to the great length of this thread section, there is no risk of untwisting so that on withdrawal of a limited thread length, a thread piece of perfect quality is always available. The thread section extending to the spool is not extracted and exhibits a limited length. In order to ensure that perfect quality is made available here too, this stationary thread section is protected against untwisting until the two thread sections of the former loop have been separated from the two loops which were formed for the thread joining process.

To carry out the method, there is used an apparatus for eliminating an irregularity in the thread with a thread joining device which is located in the vicinity of the normal thread path between delivery point and spool and which exhibits a thread separator, with a thread suction extractor associated with the separator and a pneumatic thread store disposed in the vicinity of the thread path between the delivery point and the thread joining device. According to the invention, there is provided, one above and below the pneumatic thread store, a thread inserter supplying the thread to the thread joining device and the thread suction extractor associated with the separator. There is further provided a second separator separating the thread extending to the thread store, and finally, the orifice of the thread store is disposed in such a way in the vicinity of the thread path between delivery point and thread joining device that the thread can be fed to the thread store. As one thread inserter apiece is movable above and below the thread store to form two loops which are to be joined to each other, the thread section in the thread store is located between these loops. This thread section which contains the irregularity formed by thread joining is separated by the second separator and then removed. Due to the arrangement of the orifice of the thread store in the vicinity of the thread path between delivery point and thread joining device, the thread can be supplied to the thread store for temporary storage during joining of the thread sections formed from the two loops; a second stationary thread store is consequently not necessary.

In order to avoid winding round the take-off rollers forming the delivery point when the thread is supplied to the thread joining device, advantageously a stationary thread guide is disposed between the delivery point and the path of movement of the thread inserter following it.

Feeding of the thread for storage for the duration of thread joining can, with appropriate arrangement of the thread store, be carried out by the suction air stream prevailing in it. Advantageously, however, there is provided a thread feeder movable parallel to the thread path between delivery point and spool and transversely to the thread path between delivery point and thread joining device.

In order to ensure that the thread strands are kept separate even with long thread lengths independently of the length of the thread store, according to a further characteristic of the invention a thread separator is disposed beteen the rear end of the thread store and the path of movement of the thread inserter facing towards the spool and a twist brake is disposed between this path of movement and the thread separator in the vicinity thereof. As a result of severing of the thread, two thread sections arise between the two loops to be inserted in the thread joining device, one of which grows continuously due to the thread delivered subsequently by the delivery point and is thus prevented from untwisting. The stationary thread section connected to the spool with constant, relatively short length on the other hand is prevented from untwisting by the twist brake. If the two thread inserters during formation of the two loops derive corresponding thread lengths from the thread store, thread sections of good quality are available to them in this way.

Preferably, the thread separator is disposed in the thread store at a distance from its orifice and the twist brake is disposed between the orifice and the thread separator on the inner wall of the thread store facing towards the spool. In this way, the apparatus according to the invention is particularly compact. Further the result is that the thread lengths needed to form the two loops to be inserted in the thread joining device can be derived from the thread sections in the thread store, an otherwise necessary separate thread reserve between thread store and spool can, hence, be omitted.

If the separator moves through the region in which the subsequently delivered thread section is drawn off, the pneumatic thread take-off is interrupted and the thread section blocked whereby the thread section temporarily does not adopt an extended position. At high delivery speeds, knots can arise in the thread section therein. Hence, it is possible for the thread section to obstruct the thread store, so that even after release of the thread store, it can no longer be taken off by the thread separator. In order to obviate the risk of obstruction of the thread store and uncontrolled knot formation, according to a further characteristic of the invention, the thread separator exhibits a stationary blade disposed in the inner wall of the thread store carrying the twist brake and a blade which coacts with this and which is movable only through the part of the cross-sectional area of the thread store facing towards the twist brake. In order to grip the stationary thread section to be severed with certainty and in order to prevent the thread section from sliding off the movable blade, according to the invention, the movable blade has a hooked free end.

The stationary thread section is held by the elongate cross-sectional shape of the thread store in the region of the movable blade. According to the length of the suction air pipe, however, the stationary thread section flaps up and down in the thread store. In order to ensure that the movable blade nevertheless grips this thread section reliably for separation, the thread section is fixed in the pivot region of the movable blade. This occurs due to the fact that the thread store is angled transversely to the direction of thread travel provided in front of the orifice on its side facing away from the orifice and further a shoulder is provided which recedes on its side facing towards the twist brake and which forms the rectilinear continuation of the side wall of the thread store located in front of the bend and facing towards the bend. By the deflection, which needs to be only slight, the stationary thread section on accumulation of the loop slides over the shoulder and then remains there so that the thread section is fixed in the region of the movable blade. The deflection can be adapted to the mechanical conditions and constructed as a single or even as an S-shaped bend. If the thread store is divided by a constriction in relation to the direction of thread travel provided in front of the orifice, the shoulder is appropriately disposed in extension of the constriction. Particularly advantageous is a design of the thread store according to the invention in which the part of the side wall of the thread store exhibiting the shoulder ends in the manner of a ramp on the side facing away from the twist brake and the thread store is angled in this direction in the region of the lateral bend.

The twist brake can be constructed in various different manners. According to the preferred embodiment, the twist brake is constructed as a suction air opening which is provided in the thread store and which advantageously exhibits an elongate cross-section wherein its larger diameter extends in the longitudinal direction of the thread store. By the suction air stream acting in the suction air opening, the stationary thread section is kept remote from the subsequently delivered thread section. The deflection at the suction air opening and the thread tension produced by the suction effectively prevent untwisting of the thread section so that the exceptional quality of the thread section is preserved. The elongate cross-section of the suction air opening facilitates drawing in of the end of the stationary thread section. According to a simple embodiment of the invention, the suction air opening communicates with the part of the thread store facing away from the orifice, so that a separate suction air source is not necessary for the suction air opening.

But the twist brake may also be constructed mechanically. Even here, different designs are possible. Preferably, the twist brake is constructed as a retaining clothing mounted on the inner wall of the thread store, advantageously a burr-like retaining clothing.

According to a further embodiment of the invention, the twist brake is constructed as a wall of the thread store which is located on the inside of a curvature of the thread store. A twist brake constructed as a thread clamp which may be resilient or controllable has also proved to be advantageous.

There is associated with the thread store a lock member which is controllable by a central control device and which appropriately can be triggered in dependence upon operation of the thread joining device, with interposition of a timing element.

The invention renders possible in a simple manner temporary storage of a thread and making available of two thread sections of exceptional quality for a joining process wherein the irregularity contained in the thread is separated and thus eliminated. The irregularity may have arisen therein by joining of the thread, but it may also be formed by a thick or thin point in the thread which is detected by a thread monitoring device. The subject of the invention as a rule finds application in open-end spinning machines with a thread joining device movable long the spinning stations wherein it leads to an essentially simpler and compact solution compared with the devices known up to now.

Further advantages and details appear from the description below. The invention is therein explained in more detail with the aid of drawings.

DESCRIPTION OF A PREFERRED EMBODIMENT

For simplicity's sake, let it be assumed below that with the thread joining device, we are dealing with a knot tying device, but other thread joining devices, e.g. twist-in devices according to German Offenlegungschrift No. 1,510,561, may also find application in connection with the subject of the invention.

Figure 7:
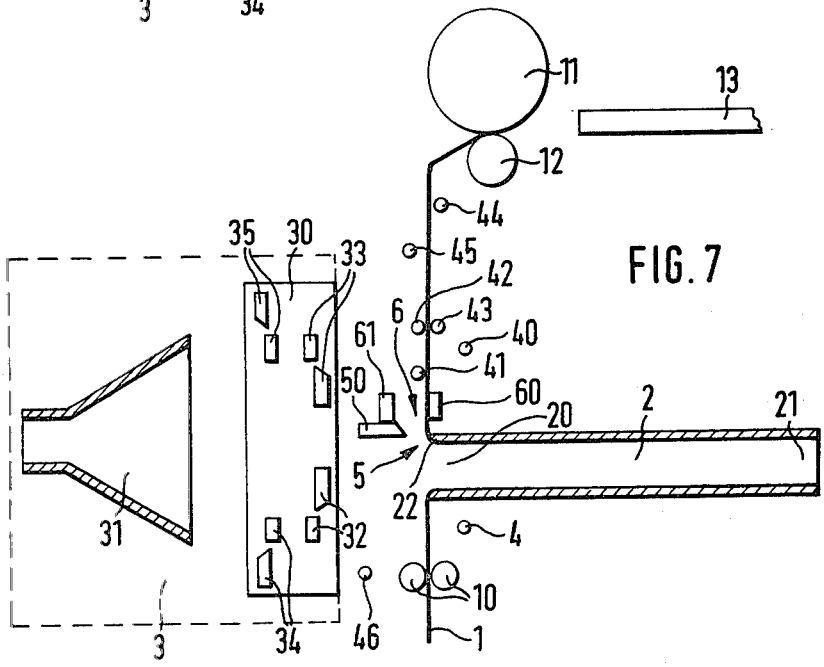

The invention is described with the aid of a conventional open-end spinning apparatus of which only the parts absolutely necessary for comprehension of the invention are shown. The thread 1, which is produced in a known manner in an open-end spinning chamber (not shown) constructed for example as a spinning rotor, is taken off out of the spinning rotor by a pair of take-off rollers 10 and passed to a spool 11 which is driven by a drive shaft 12 (FIG. 7). Associated with the spool 11 is a spool supporting element 13 by means of which the spool 11 can be lifted off the drive shaft 12. In the region of the thread path between the take-off rollers 10 forming a delivery point and the spool 11 is located the orifice 20 of a thread store 2 of which the end 21 facing away from the orifice 20 communicates with a vacuum source (not shown).

A thread joining device 3 exhibiting for example a knot tying device 30 is movable along the open-end spinning machine and can be moved into a position opposite the orifice 20 of the thread store 2. On the side of the tying device 30 facing away from the thread store 2, the thread joining device 3 exhibits a thread suction extractor 31 which is connected to a fan (not shown) entrained by the thread joining device 3 or via a pipe (not shown) to the vacuum source of the open-end spinning machine.

The knot tying device 30 exhibits on its side facing towards the thread store 2 two separators 32 and 33 disposed one above the other and on its side facing towards the thread suction extractor 31 two further separators 34 and 35 disposed one above the other.

Figure 2:
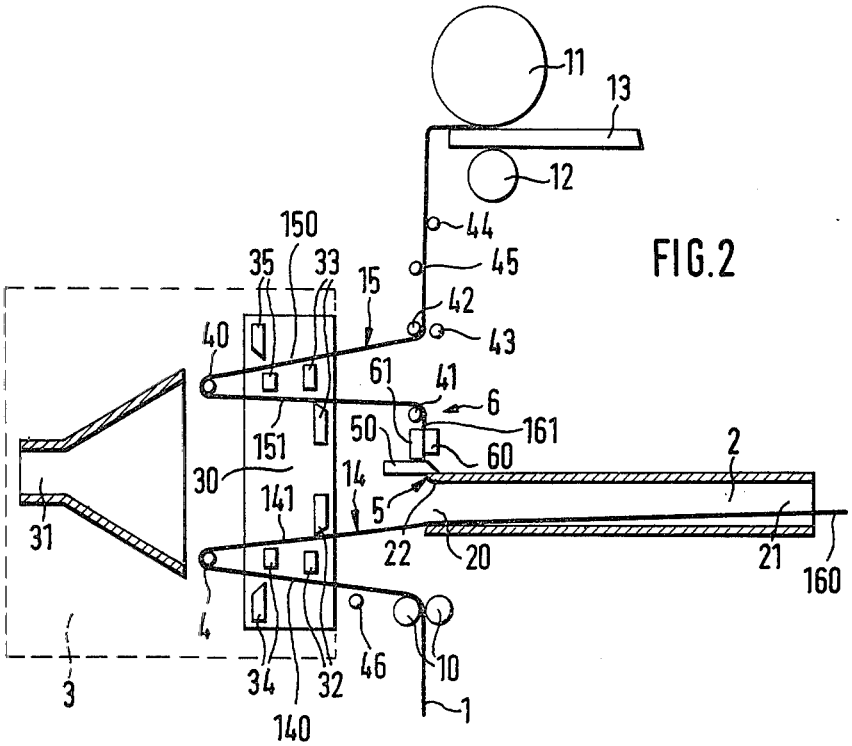

Both below and above the pneumatic thread store 2 is disposed a thread inserter 4 and 40 by means of which the thread 1 can be inserted in the thread joining device 3 in such a way that the thread section 140 or 150 which is outermost at any given time with respect to the tying device 30 of the loops 14 and 15 formed by the thread inserters 4 and 40, is located in the region of the separator 34 or 35, and the thread section 141 or 151 which is innermost with respect to the tying device 30 is located in the region of the separator 32 or 33 (FIG. 2). According to the design of the subject of the invention, there may therein be disposed below and above the path of movement of one or both thread inserters (e.g. 40) thread guides 41 and 42 which retain the thread 1 below and above this path of movement in the normal thread path.

Above the path of movement of the thread inserter 40 are located two thread guides 43 and 44 between which a reserve arm 45 is movable.

Between the path of movement of the thread inserter 40 and the thread store 2 is located a thread separator 5 which, in the embodiment shown, is formed by a movable blade 50 and the upper edge 22, constructed as a counter-cutting edge, of the orifice 20 of the thread store 2. Between the thread separator 5 and the path of movement of the thread inserter 40 is located a twist brake 6 which consists of a stationary clamping jaw 60 and a clamping jaw 61 movable with the blade 50.

Below the thread path, between the take-off rollers 10 forming the delivery point and the thread joining device 3 is disposed a thread feeder 46 which is movable transversely to this thread path up to the level of the orifice 20 of the thread store 2 or slightly higher, approximately parallel to the normal thread path shown in FIG. 7.

The apparatus described above in construction operates as follows:

During the normal spinning state shown in FIG. 7, the thread 1 produced in the spinning chamber is continuously taken off from the spinning chamber by means of the take-off rollers 10 and wound up by the spool 11 driven by the drive shaft 12. If a thread breakage occurs, this fault is indicated by a thread monitor (not shown). At the same time, fiber feed into the spinning chamber is interrupted and by means of the spool supporting element 13, the spool is lifted off the drive shaft 12 and, hence, stopped.

Figure 1:
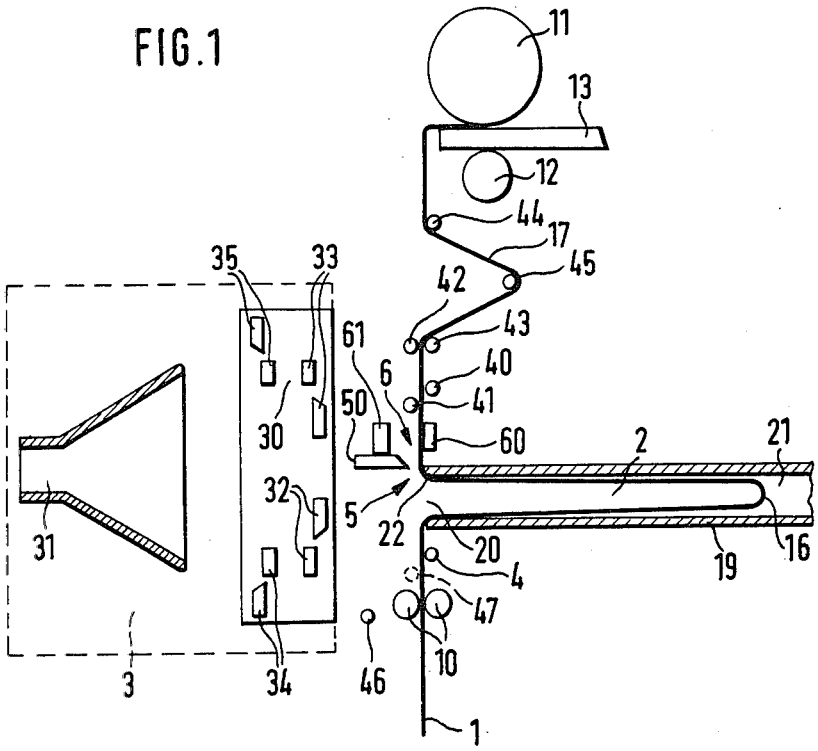
FIGS. 1–7 show the apparatus according to the invention schematically in the various working stages.

The operator, whose attention has been drawn to the fault by the indicator which was operated by the thread monitor, now seeks the thread end on the spool and introduces it, forming a reserve length on the reserve arm 45 and cutting down to a length suitable for joining on, into the spinning chamber where joining to the fibers, which have been refed in the meantime takes place in a known manner. The thread reserve 17 stored by the reserve arm 45 is therein maintained (FIG. 1).

After joining on has taken place, the thread 1 continuously taken off from the spinning chamber by the take-off rollers 10 is constantly guided away through the thread store 2 as the spool 11 is still lifted off the drive shaft 12 and winding up consequently has not yet begun. In the process, the thread join which constitutes a flaw in the thread also enters the thread store 2 and is removed. A loop 16 becoming larger and larger is therein formed in the thread store 2.

When the loop 16 is sufficiently large for it to be ensured that the thread 1 is continuously removed further, even after severing of the loop but before the risk of entanglement of the two strands of the loop 16 arises, the separator 5 and simultaneously the twist brake 6 are actuated (FIG. 2). The loop 16 is severed and the subsequently delivered thread section 160 is continuously removed. The other thread section 161 formed by severing is held by the clamping jaws 60 and 61 and prevented from untwisting.

By means of the two thread inserters 4 and 40, which are displaceable or pivotable for this purpose, there are now formed above and below the thread store 2 two loops 14 and 15 which are inserted in the tying device 30 and therein enter the region of action of the thread suction extractor 31. The tying device may be any suitable conventional tying device such as disclosed in U.S. Pat. Nos. 4,083,171 or 4,232,508. In the process, as the speed of loop formation is greater than the delivery speed of the take-off rollers 10, the thread section 160 is partly withdrawn from the thread store 2. On the other hand, the thread reserve 17 held by the reserve arm 45 is used up in formation of the loop 15 wherein the reserve arm 45 is controlled in dependence upon movement of the thread inserter 40. Any suitable thread inserter such as the thread inserters 29 shown in U.S. Pat. No. 4,083,171 can be utilized.

As the thread sections 161 and 160 are forcibly kept separate from each other prior to formation of the loops 14 and 15 by severing of the loop 16, and as both thread ends arising herein are prevented from untwisting, thread sections of perfect quality are available for formation of the loops 14 and 15. Untwisting of the thread section 160 is prevented by its length, and untwisting of the thread section 161 is prevented by means of the twist brake 6.

Figure 3:
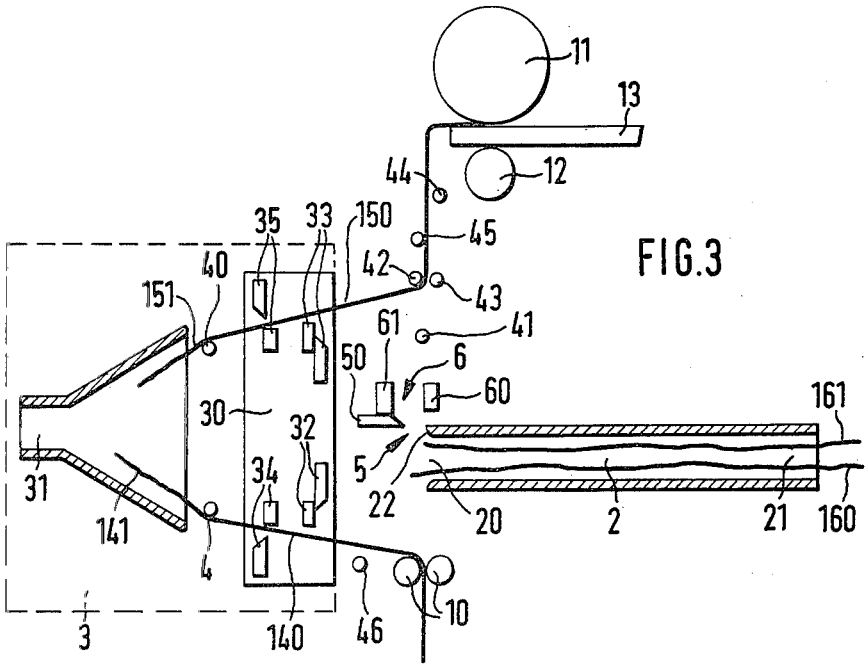

By means of the separators 32 and 33 which, where loops 14 and 15 are sufficiently close to each other, may also be combined into a single common separator, the thread sections 141 and 151 are severed while at the same time, the twist brake 6 opens (FIG. 3). The separators 33 and 32 may be any suitable conventional separators such as disclosed in U.S. Pat. No. 4,083,171. The separated portion of the thread section 141 is now drawn off together with the thread section 160 through the thread store 2, while at the same time the separated portion of the thread section 151 is drawn off together with the thread section 161 through the thread store 2. Hence, now at last, the portion of the thread 1 containing the flaw (thread join or other thick or thin points in the thread) has also been removed.

The portion of the thread sections 141 and 151 still in the thread joining device 3 is now drawn and held taut under the effect of the vacuum prevailing in the thread suction extractor 31.

Figure 4:
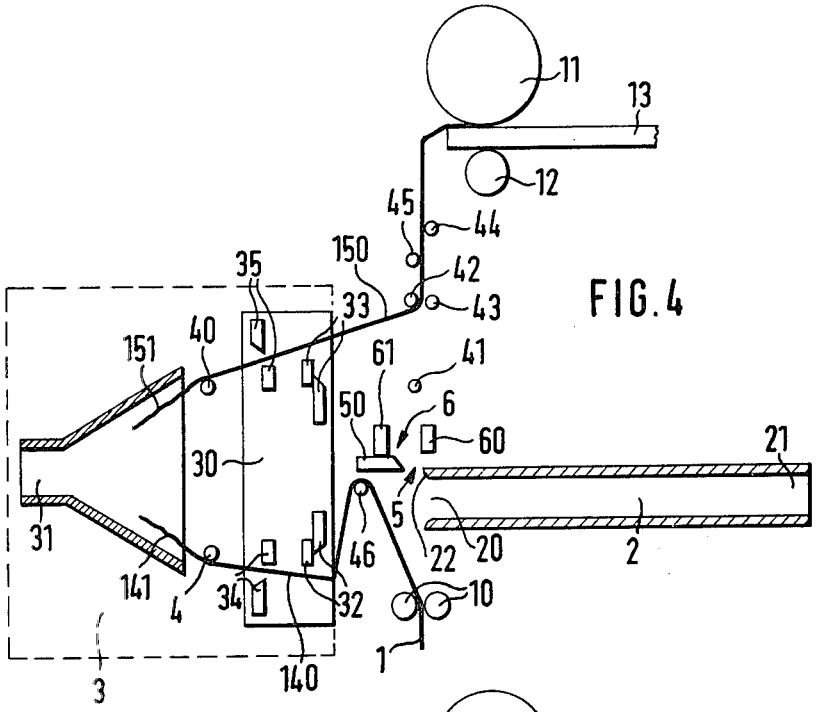

The subsequently delivered thread 1 is now moved by the thread feeder 46 in front of the orifice 20 of the thread store 2 (FIG. 4). If the thread path of the thread delivered by the take-off rollers 10 and extending to the thread joining device 3 is guided very close past the orifice 20 of the thread store 2, the thread feeder 46 can also be omitted, as then the suction air stream acting in the thread store 2 is sufficient to draw the thread 1.

Figure 5:
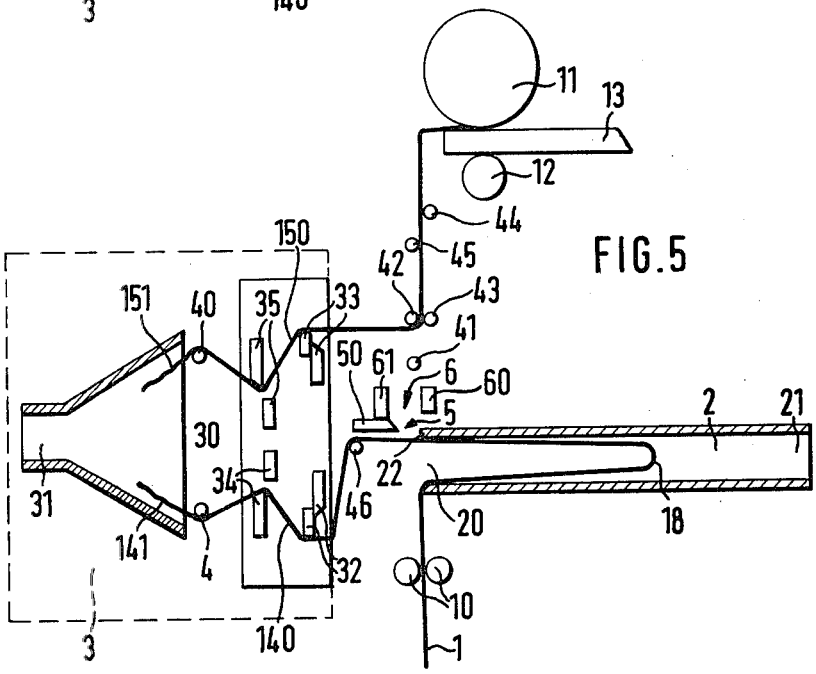
Figure 6:
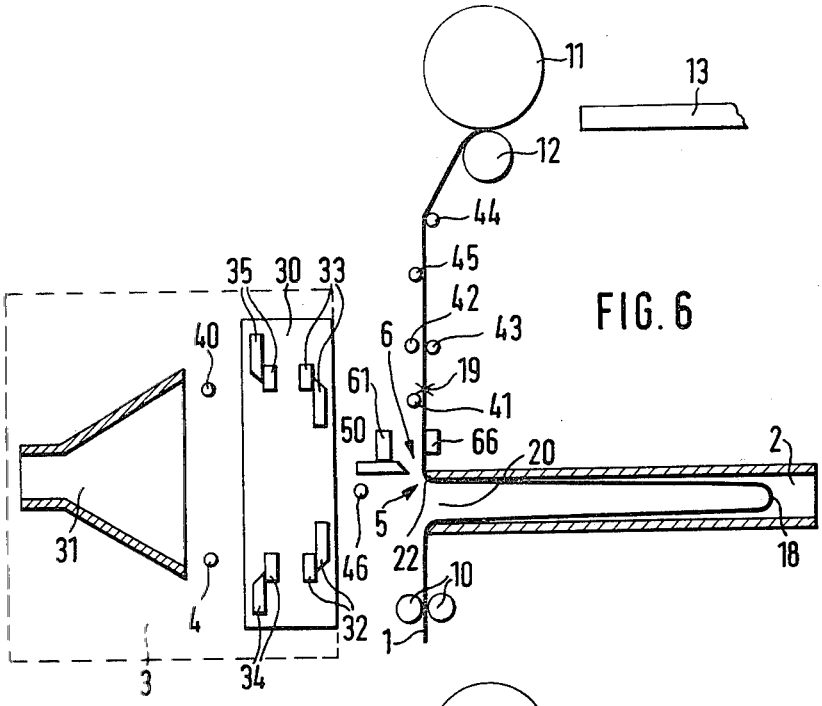

While the thread 1 is now drawn into the thread store 2 for temporary storage in the form of a loop 18, the tying process takes place in the tying device 30 (FIG. 5). The separators 34 and 35 form part of the tying elements and separate the excess ends after carrying out of the tying process which are now removed by the thread suction extractor 31 (FIG. 6).

The spool supporting element 13 is now withdrawn in dependence upon operation of the tying device 30 and herewith releases the spool 11 again which is hereby lowered onto the drive shaft 12 and driven again. The tying point 19, hence, leaves the tying device 30 and passes into the normal thread path between take-off rollers 10 and spool 11. The loop 18 is gradually used up so that the thread 1 finally again adopts the thread path shown in FIG. 7. The thread inserters 4 and 40, which exhibit chamfered thread deflecting surfaces on their side now facing towards the thread path, return to their normal positions wherein the thread 1 on account of the thread deflecting surfaces passes between thread inserter 4 or 40 and thread joining device 3. Therewith is ended the process of elimination of an irregularity in the thread, and the thread joining device 3 can take up operation at another spinning station. The thread joining device 3 may therein be moved to its operation position manually, semi-automatically or automatically.

According to the invention, the thread 1 is inserted in the thread joining device 3 above and below the extracted loop 16 in the form of two loops 14 and 15. The loop 16 between the two loops 14 and 15 is separated and removed and the subsequently delivered thread 1 is moved into the region of the previously pneumatically removed loop 16. There, namely in the same thread store 2, it is stored temporarily while the thread sections 140 and 150 which have arisen are joined together and the excess ends of the thread sections 141 and 151 are separated and removed by means of the thread suction extractor 31. Only a single stationary suction device constructed as a thread store 2 is required per spinning station. The thread suction extractor 31 is disposed on the movable thread joining device 3 and, hence, provided only once for the group of spinning stations which are served by the movable thread joining device.

Furthermore, the functional reliability of the subject of the invention is increased by the fact that the thread 1 extracted in the form of a loop 16 is severed after reaching a fixed minimum loop size, the subsequently delivered thread section 160 is extracted further and the stationary thread section 161 is kept separate from the subsequently delivered thread section 160 and prevented from untwisting by means of the twist brake 6 until the two loops 14 and 15 are inserted in the thread joining device 3. As knotting and uncontrolled breaking of the thread 1 in the thread store 2 is hereby prevented, it is ensured that thread lengths of exceptional quality and sufficient length are always available for formation of the two loops 14 and 15.

In the example of the invention described in construction and function, there is provided between the path of movement of the thread inserter 40 facing towards the spool 11, and the spool, a separate thread reserve 17 from which the thread inserter 40 derives the thread length needed to form the loop 15. This thread reserve 17, as well as the thread guides 43 and 44 and reserve arm 45 needed for it, can be omitted if the thread separator 5 and the twist brake 6 are shifted into the thread store 2. Then the thread guide 41, too, is omitted.

Figures 10, 11:
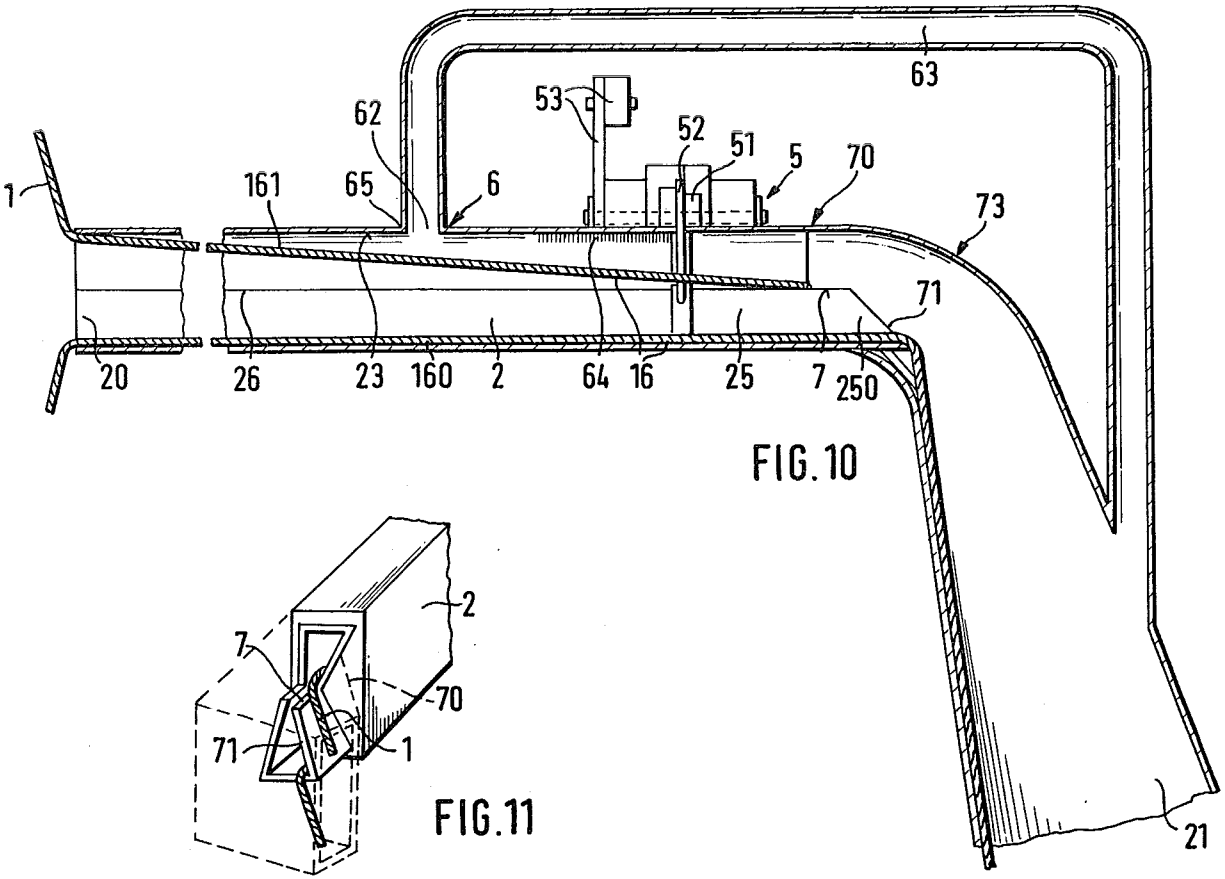
FIG. 10 shows a cross-section through a modified construction of the thread store according to the invention.
FIG. 11 shows a detail of the thread store according to the invention in perspective.

Such an example is now explained with the aid of FIG. 10. The spinning apparatus and the thread joining device 3 are, except in the omitted elements just quoted, constructed in the same way as is the case in the example according to FIGS. 1–7. As the space required for the thread separator 5 and for the twist brake 6 both disposed outside the thread store 2 in the above described embodiment is not needed, the apparatus according to FIG. 10 becomes more compact than the above described apparatus. As the reserve arm 45 with the control means required for it is omitted, the apparatus is also essentially simpler from the controls.

Figure 9:
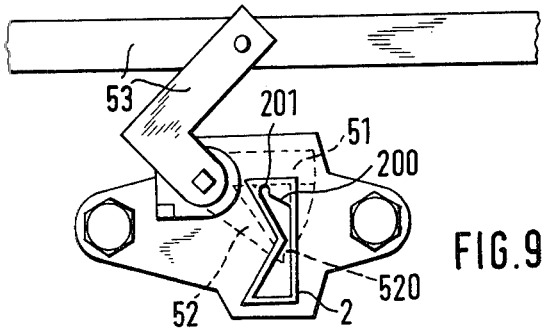
FIG. 9 shows a front view of the thread store with the thread separator according to the invention for the stored thread.

According to FIG. 10, the thread separator 5 is disposed in the thread store 2 at a distance from its orifice 20 and the twist brake 6 is disposed between the orifice 20 and the thread separator 5 in the vicinity thereof on the inner wall 23 of the thread store 2 facing towards the spool 11. The thread separator 5, according to FIGS. 9 and 10, exhibits a blade 51 disposed in the inner wall 23 carrying the twist brake 6 and a movable blade 52 which cooperates with it and which can be moved relative to the stationary blade 51 via a linkage 53 from a central control point. The twist brake 6 consists in the embodiment shown of a suction air opening 62 which is provided between the thread separator 5 and the orifice 20 of the thread store 2 in the inner wall 23 and which communicates via a pipe 63 with the end 21 of the thread store 2 on the other side of the thread separator 5. The twist brake 6 consists furthermore of a retaining clothing 64 which is constructed as a felt or plush covering or preferably also in burr form.

Due to the vacuum acting in the rear end 21 of the thread store 2, the thread section 161 is retained via the suction air opening 62 adjacent to the inner wall 23 and to the retaining clothing 64 on this wall which prevents untwisting of the thread 1. Application of the thread to the retaining clothing 64 is also aided by the upward movement of the movable blade 52 during the separation process. When the loop 15 is later formed from the thread section 161, the thread section ending at the blade 52 is hereby drawn out of the retaining clothing 64 and thus released for later pneumatic removal.

It is not necessary for the suction air opening 62 and the retaining clothing 64 to find application in combination, but either the suction air opening 62 or the retaining clothing 64 suffices for this purpose.

Figure 8:
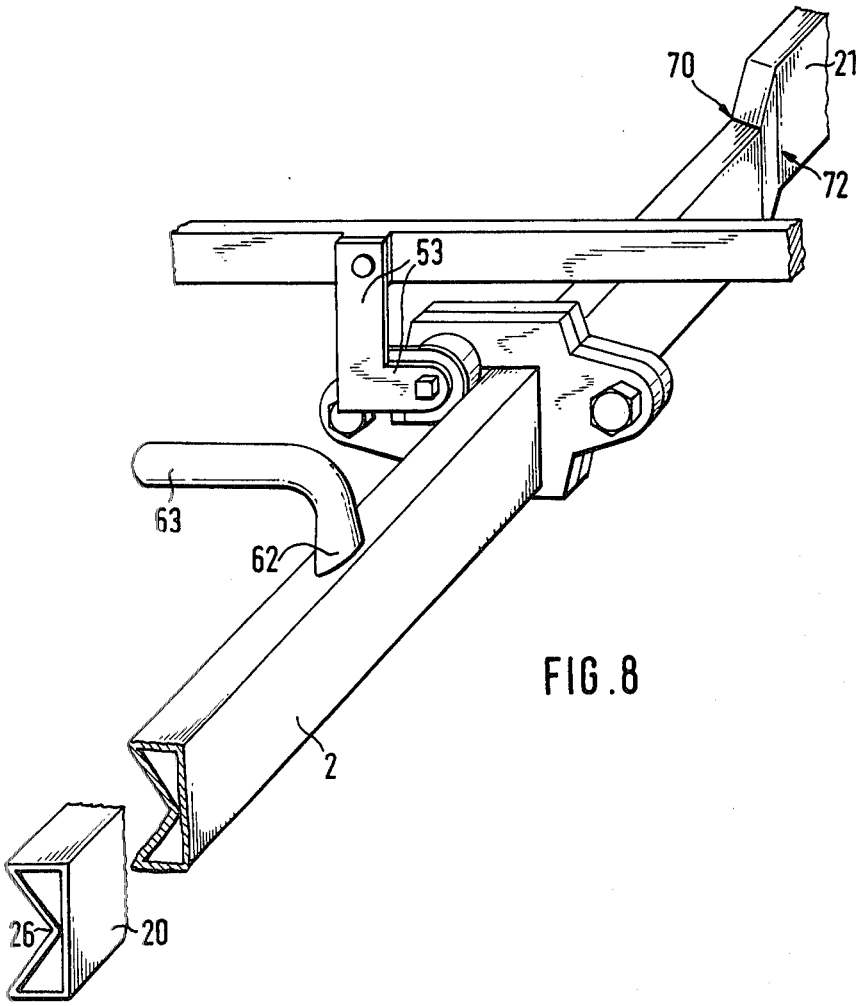
FIG. 8 shows a perspective view of a thread store constructed according to the invention.
Figure 12:
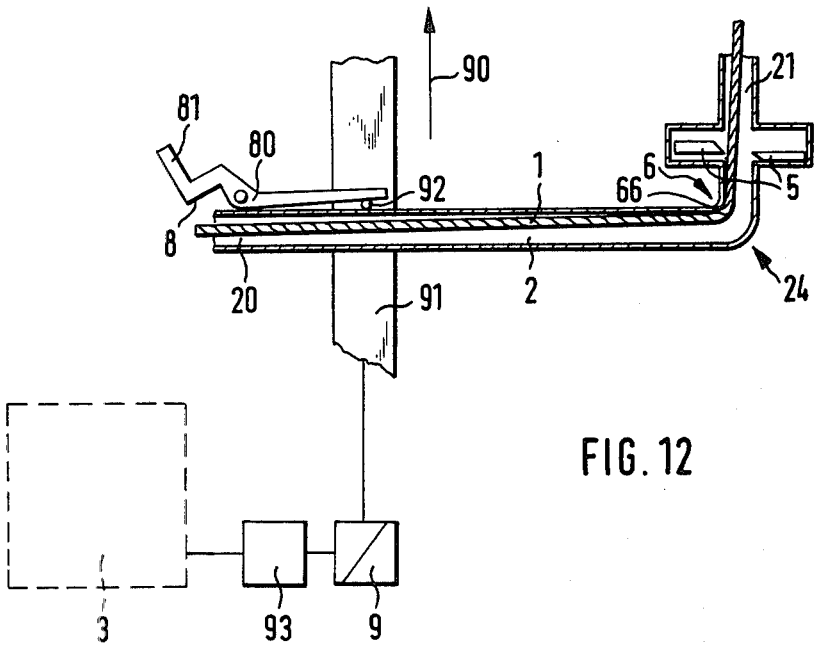
FIG. 12 shows schematically a further modified form of the invention.

In order to facilitate drawing of the thread through the suction air opening 62 and thus hold it taut around the edge 65 between the front portion of the thread store 2 and the pipe 63, so that deflection at edge 65 serves as a twist brake 6, the suction air opening 62 may also exhibit an elongate cross-section, wherein its larger diameter extends in the longitudinal direction of the thread store 2 (FIG. 8). FIG. 12 shows an embodiment of the thread store 2 according to the invention in which the thread separator 5 is disposed behind a curvature 24 of the thread store 2 wherein the edge 66 on the inside of the curvature 24 forms the twist brake 6.

As shown, a common vacuum source may be used for the thread store 2 and the suction air opening 62. In order to be able to control the vacuum where occasion arises in the suction air opening 62 independently of the vacuum in the thread store 2, separate vacuum sources may also be advantageous.

The twist brake 6 may, as was illustrated with the aid of FIGS. 1–7, be constructed as a clamp. This clamp may be controllable according to FIGS. 1–7, but it may also be constructed resiliently. In this case, the thread section 161 is inserted in the clamp on account of movement of the blade 52, whereas it is drawn out of the clamp during formation of the loop 15 in the manner described above in connection with the retaining clothing 64. A spring plate mounted on one wall of the thread store 2 or a wire strap fixed there may, for example, be used as a resilient clamp which forms with the wall of the thread store 2 a narrowing gap into which the thread 1 is introduced during lifting or pivot movement of the blade 52. Preferably, therefore, this clamp is located in the immediate vicinity of the thread separator 5.

In order for the thread 1 forming the loop 16 to be kept constantly taut in the thread store 2, the air stream should be choked as little as possible. Although in principle, to form the two thread sections 160 and 161 both the upper and the lower strand of the loop 16 could be severed, this is advantageously avoided. For with severing of both thread strands, such a large part of the cross-section of the thread store 2 is closed by the movable blade 52 that choking of the air stream occurs and, caused by this, temporary interruption of thread take-off, so that the thread thus accumulates in front of the orifice 20 of the thread store 2 or in the thread store 2. But again, by this is caused the risk of knot formation in the thread sections 160 and 161 which are to serve to form the loops 14 and 15. In order to counter this risk, according to a further embodiment of the invention, the movable blade 52 is disposed so that it is movable only through the part of the cross-sectional area facing towards the twist brake 6; i.e. essentially through this half of the cross-sectional area, of the thread store 2. In order for the thread section 161 to be gripped with certainty by the movable blade 52 herein, the latter has a hooked free end 520 according to FIG. 9.

The loop 16 in the thread store 2 does not adopt an unchanging position, but flaps slightly to and fro in the thread store 2. Hence, it may occur that the movable blade 52, in spite of application of a hooked end 520, does not securely grip or does not securely hold the thread section 161 so that faulty cuts are the result. In order to fix the thread section 161 in the thread store 2 in such a way that such faulty cuts do not occur, according to FIGS. 8, 10 and 11, the thread store 2 is angled transversely to the direction of thread travel provided in front of the orifice 20 and, hence, transversely to the loop 16 on its side facing away from the orifice 20. Moreover, there is provided in the thread store 2 a shoulder 7 which recedes on its side facing towards the twist brake 6 and which forms the rectilinear continuation of the side wall 25 of the thread store 2 located in front of the bend 70 and facing towards the bend. Due to the bend 70, the thread section 161 of the growing loop 16 is held adjacent to the portion 250 of the side wall 25 of the thread store 2 forming the shoulder 7 which finally slides off over the shoulder 7 while the thread section 160 remains in its former position. In this way, reliable positioning of the thread section 161 in front of the blade 52 and good separation from the thread section 160 is achieved. In order to further improve this effect, the thread store 2 may be divided by a constriction 26 in a known manner in relation to the direction of thread travel provided in front of the orifice 20, wherein the shoulder 7 is disposed in extension of this constriction 26. A further improvement in keeping the two thread sections 160 and 161 separate is obtained if the portion 250 of the side wall 25 of the thread store 2 exhibiting the shoulder 7 ends gradually sloping down in the manner of a ramp 71 on the side facing away from the twist brake 6 and at the same time the thread store 2 is also angled on the side facing away from the twist brake 6 in the region of the lateral bend 70. Due to this additional bend 73, the thread section 160 is prevented from likewise passing onto the shoulder 7 by flapping while the thread section 161 can slide up the ramp 71 onto the shoulder 7.

It is not necessary for the direction of the rear portion of the thread store 2 obtained by the bend 70 to be maintained. For instance, according to FIG. 8, the bend 70 is followed by a bend 72 in the opposite direction so that the rear portion of the thread store 2 indeed runs slightly offset, but parallel to the front portion of the thread store 2.

Keeping the thread sections 160 and 161 of loop 16 separate in the thread store 2 can also be further facilitated by the fact that the edge 200 of the orifice 20 of the thread store 2 facing towards the spool 11 extends obliquely and ends at its end closest to the spool 11 in a notch 201 receiving the thread 1. As a result of the tension of the thread 1 which is stationary but drawn into the thread store 2, the thread section 161 passes to the edge 200 of the orifice 20 and shifts in the endeavor to adopt the shortest path along the edge 200 until it passes into the notch 201 where it is retained. The thread section 161 which is to be severed by the thread separator 5 is thus fixed by the notch 201 and the shoulder 7 so that it is gripped with certainty by the movable blade 52.

According to FIG. 12, associated with the orifice 20 of the thread store 2 is a lock member 8 which is attached to a lever 80 which exhibits an arm 81 for opening the thread store 2. If desired, the thread joining device 3 can also take over opening of the thread store 2, as also closing after completion of the operation of thread joining. In practice, however, it is sufficient as a rule to open by hand the thread stores 2 on which operation is being carried out while the opened thread stores 2 are closed via a central control device 9 which is jointly associated with all the lock members 8. According to FIG. 12, for this purpose, there is provided a control rail 91 which is movable in the longitudinal direction of the machine and which is displaced for a short time in the direction of arrow 90 by the control device 9 constructed as an electromagnet. On the control rail, there is located per spinning station one pin 92 or other driving element which here engages the levers 80 of which the lock members 8 are in the open position in order therewith to close the thread stores 2. Due to the vacuum acting in the thread store 2, the lock members are then held in the locked position.

The already closed lock members 8 are not affected by such a movement of the control rail 91.

Control of the control device 9 can be carried out by hand. It is, however, advantageous if this control is carried out responsive to actuation of the thread joining device 3 with a delay provided by a timing element 93 of which the time is set so that it is ensured that the loop 18 in the thread store 2 is also already used up on actuation of the control device 9.

Of course, the subject of the invention can be modified in many ways. Thus, fundamentally, the thread joining device 3 and the thread store 2 can be in any position relative to each other. For example, it is not necessary for the thread joining device 3 and the thread store 2 to be opposite each other but they can also be disposed at an angle to each other. If the thread joining device 3 is to serve only to eliminate thread breakage and individually remove thick and thin points in the thread produced 1, the tying device 30 and thread store 2 can also be disposed adjacent to each other in the thread joining device 3.

Even the direction of thread transport plays no part for the present subject of the invention. Thus, the material flow can go, instead of from bottom to top as shown also from top to bottom, wherein the units of the subject of the invention are then adapted to this flow of material accordingly.

On deflection of the thread 1 by means of the thread inserter 4 to supply the thread 1 to the thread joining device 3, the angle of winding on the take-off rollers forming the delivery point 10 is increased. Thereby is increased the risk of lap formation. In order to prevent this, between the delivery point 10 (take-off rollers) and the path of movement of the thread inserter 4, there may be disposed a stationary thread guide 47 (shown in broken lines in FIG. 1) which holes the thread 1 after travel through the pair of rollers, separate from the surfaces thereof.

While a preferred embodiment of the invention has been described using specific terms, such description is for illustrative purposes only, and it is to be understood that changes and variations may be made without departing from the spirit or scope of the following claims.

We claim:

1. A method of eliminating an irregularity in a thread being supplied from a source using a thread joining device comprising:

supplying said thread with said irregularity in the form of a loop into a thread reserve (2);

inserting the thread above and below said thread reserve in the form of two additional loops into said thread joining device;

separating and removing said loop containing said irregularity;

supplying additional thread from said source to said thread reserve for being temporarily stored while thread pieces which have arisen as a result of separating and removing of said loop are joined together and excessed ends are separated and removed.

2. The method as set forth in claim 1 further comprising:

keeping said two additional loops separated from each other until said additional two loops are inserted into said thread joining device.

3. The method as set forth in claim 1 further comprising:

forming one of said two additional loops from thread being supplied from said source, and forming the other of said two additional loops from a thread extending from said thread reserved to a take-up device.

4. An apparatus for eliminating an irregularity in a thread being supplied from a source and taken up on a take-up device, a thread joining device located between said source and said take-up device, said thread joining device including a thread separator, a thread suction extractor (31) associated with said separator, and a pneumatic thread store (2) disposed adjacent said thread joining device and the thread path extending between said source and said take-up device comprising:

a pair of thread inserters means (4, 40) one being located above said pneumatic thread store (2) and the other being located below said thread store (2) for supplying said thread (1) to said thread joining device (3) and said thread suction extractor (31) associated with said separator (34,35);

a second separator (32,33) for separating said thread extending to said thread store (2);

an orifice (20) of said thread store (2) disposed adjacent said thread path between said source and said thread joining device (3) for receiving said thread having said irregularity and forming a loop therein;

means operably connected to said thread store for separating and removing said loop containing said irregularity, and means activating said thread joining device for joining the pieces of thread which have arisen as a result of separating and removing said loop.

5. The apparatus as set forth in claim 4 further comprising:

a stationary thread guide positioned between said source and said thread inserter (4) so that as said thread inserter supplies said thread joining device with said thread, and the path of said thread extends around said stationary thread guide (47).

6. The apparatus according to claim 4 further comprising:

a thread feeder means (46) movable parallel to the thread path between said source (10) and said takeup device (11) and transverse to the thread path between said source (10) and said thread joining device (3).

7. The apparatus according to claim 4 further comprising a thread separator (5) positioned between a rear end (21) of said thread store (2) and path of movement of said thread inserter (40);

a twist brake (6) positioned between said thread separator (5) and said takeup device closely adjacent said thread store (2) for gripping a piece of said thread formed responsive to said loop being separated and removed in said thread store.

8. The apparatus as set forth in claim 7 further comprising:

said thread separator (5) being disposed in said thread store (2) at a distance from said orifice (20), and said twist brake 6 is disposed between said orifice (20) and said thread separator (5) on an inner wall of said thread store facing towards said takeup device (11).

9. The apparatus set forth in claim 8 further comprising:

said thread separator (5) including a stationary blade (51) disposed in an inner wall of said thread store (2) upon which said twist brake (6) is positioned, and a blade (52) which coacts with said stationary blade (51) which is movable through a portion of the cross sectional area of said thread store (2) facing towards said twist brake (6).

10. The apparatus set forth in claim 9 further comprising:

a hook free end provided on said movable blade.

11. The apparatus set forth in claim 8 further comprising:

said thread store (2) being angled transversely to the direction of thread travel provided in front of said orifice (20) on its side facing away from said orifice (20), a shoulder (7) provided on said thread store (2) which recedes on its side facing said twist brake (6), said thread store including a side wall, said shoulder forming a rectilinear continuation of said side wall (25), and a bend following said shoulder (7).

12. The apparatus set forth in claim 11 further comprising a constriction (26) dividing said thread store in relation to the direction of travel of said thread in front of said orifice, and said shoulder (7) being disposed in an extension of said constriction (26).

13. The apparatus as set forth in claim 11 further comprising:

a portion (250) of said side wall (25) of said thread store exhibiting said shoulder (7) terminates in a ramp (71) on a side facing away from said twist brake (6); and a lateral bend (70) provided in said thread store (2) and being angled in the same direction as said ramp.

14. The apparatus set forth in claim 8 further comprising an edge (200) of said orifice facing towards said takeup device and extending obliquely and at an end closest to said takeup device (11) terminating in a notch (201) for receiving said thread (1).

15. The apparatus set forth in claim 8 further comprising:

said twist brake being constructed as a suction air opening (62) provided in said thread store (2).

16. The apparatus set forth in claim 15 further comprising:

said suction air opening (62) having an elongated cross section with its larger diameter extending in the longitudinal direction of said thread store (2).

17. The apparatus according to claim 15 further comprising said suction air opening (62) communicating with a portion of said thread store (2) facing away from said orifice (20).

18. The apparatus according to claim 8 further comprising:

said twist brake (6) being a retaining clothing (64) mounted on an inner wall (23) of said thread store (2).

19. The apparatus according to claim 18 further comprising said retaining clothing (64) being a burr-like retaining clothing.

20. The apparatus according to claim 8 further comprising:

a curve provided in said thread store (2);

said twist brake (6) being constructed as a wall located on the inside of said curve (24).

21. The apparatus set forth in claim 4 further comprising:

said twist brake (6) being a thread clamp (60, 61).

22. The apparatus according to claim 4 further comprising a lock member (8) associated with said thread store (2), and a central control device (9) operably connected to said lock member (8).

23. The apparatus set forth in claim 22 further comprising a timing element (93), means for connecting said thread joining device (3) through said timing element which activates said control device (9) for said lock member (8) of said thread store (2) responsive to a lapse of a predetermined period of time.

24. An apparatus for removing an irregularity in a thread extending between a source and a thread takeup device comprising:

a tubular thread reserve positioned adjacent the path of travel of said thread, means for applying suction to said thread reserve causing a thread loop containing said irregularity to be formed in said thread reserve, a thread joining device provided adjacent said thread reserve on an opposite side of the normal path of said thread;

a thread suction extractor operably associated with said thread joining device;

means for forming a first loop in said thread between said thread reserve and said takeup device and inserting said first loop into said joining device;

means for forming a second loop in said thread between said thread reserve and said source and for inserting said second loop in said joining device in space relation to said first loop;

means for severing said thread loop containing said irregularity and removing said severed portion; and means for activating said joining device causing portions of said first and second loops of said thread to be joined.

* * * * *